US008002279B2

(12) United States Patent
Chetrit Russi et al.

(10) Patent No.: US 8,002,279 B2
(45) Date of Patent: Aug. 23, 2011

(54) DEVICE AND METHOD FOR UNLOADING LAMINAR ELEMENTS FROM A ROLL AND TRANSFERRING STACKS OF LAMINAR ELEMENTS, AND ROLL USED FOR SAME

(75) Inventors: Ricard Chetrit Russi, Salt (ES); Ferran Burch Gonzalez, Salt (ES); David Miravete Guerrero, Girona (ES)

(73) Assignee: Kontrelmec, S.L., Aiguaviva (ES)

( * ) Notice: Subject to any disclaimer, the term of this patent is extended or adjusted under 35 U.S.C. 154(b) by 0 days.

(21) Appl. No.: 12/570,697

(22) Filed: Sep. 30, 2009

(65) Prior Publication Data

US 2010/0013146 A1 Jan. 21, 2010

Related U.S. Application Data

(63) Continuation of application No. 11/658,209, filed as application No. PCT/ES2005/000476 on Aug. 26, 2005, now abandoned.

(30) Foreign Application Priority Data

Aug. 27, 2004 (ES) ..... 200402095
Aug. 27, 2004 (ES) ..... 200402096

(51) Int. Cl.
*B65H 29/54* (2006.01)

(52) U.S. Cl. ..... 271/312; 271/313; 271/215; 271/217; 414/790.3

(58) Field of Classification Search ..... 271/312, 271/313, 217, 218, 215, 196; 414/790.3
See application file for complete search history.

(56) References Cited

U.S. PATENT DOCUMENTS

| | | | |
|---|---|---|---|
| 3,759,402 | A | 9/1973 | Hitch et al. |
| 3,889,824 | A | 6/1975 | Wood |
| 4,102,253 | A | 7/1978 | Gannicott |
| 4,190,241 | A | 2/1980 | Krueger |
| 4,202,542 | A | 5/1980 | Lammers et al. |
| 4,934,687 | A | 6/1990 | Hayden et al. |
| 5,383,001 | A | 1/1995 | Bosy |
| 5,988,065 | A | 11/1999 | Schroder et al. |
| 6,295,922 | B1 | 10/2001 | Salamone et al. |
| 6,581,927 | B2 | 6/2003 | Claudio |

(Continued)

FOREIGN PATENT DOCUMENTS

EP 0 364 790 A2 4/1990

(Continued)

OTHER PUBLICATIONS

International Search Report for PCT International Application No. PCT/ES2005/000476 mailed Dec. 2, 2005.

*Primary Examiner* — David H Bollinger
(74) *Attorney, Agent, or Firm* — RatnerPrestia

(57) ABSTRACT

A device and method for unloading laminar elements from a roll and transferring stacks of such laminar elements, and to the roll used for the same. The method including unloading sheets from a roll with the aid of a barrier; receiving the sheets on a support, such as to form a growing stack; positioning a separator between two adjacent sheets in which the first sheet completes a finished stack on the support and the second sheet is held by the separator in order to begin a new stack; moving the support to an outlet support and pushing the finished stack with the aid of a push element in order to transfer same from the support to the outlet support; moving the support to the position of the separator and removing the separator in order to transfer the growing stack from the separator to the support. The invention also relates to the device used to implement the method.

44 Claims, 11 Drawing Sheets

U.S. PATENT DOCUMENTS

| | | | |
|---|---|---|---|
| 6,832,886 | B2 | 12/2004 | Michler et al. |
| 6,877,740 | B2 | 4/2005 | Michler et al. |
| 7,178,801 | B2 | 2/2007 | Kokubo et al. |
| 2003/0082044 | A1 | 5/2003 | Gendron et al. |

FOREIGN PATENT DOCUMENTS

| | | | |
|---|---|---|---|
| EP | 0 561 100 | A1 | 9/1993 |
| EP | 0 579 985 | A1 | 1/1994 |
| WO | WO 92/04265 | | 3/1992 |
| WO | WO 99/29599 | | 6/1999 |

DEVICE AND METHOD FOR UNLOADING LAMINAR ELEMENTS FROM A ROLL AND TRANSFERRING STACKS OF LAMINAR ELEMENTS, AND ROLL USED FOR SAME

CROSS REFERENCE TO RELATED APPLICATIONS

This application is a Continuation Application of U.S. patent application Ser. No. 11/658,209, filed Jan. 23, 2007, which is a U.S. National Phase Application of PCT Application No. PCT/ES2005/000476, filed Aug. 26, 2005 which claims priority of Spanish Application No. P2004/02095, filed Aug. 27, 2004 and Spanish Application No. P2004/02096, filed Aug. 27, 2004.

FIELD OF THE INVENTION

The present invention relates to a device and method for unloading laminar elements from a roll, and forming and transferring stacks of such laminar elements. The laminar elements can be, for example, labels, leaflets, loose sheets, etc., made of different materials, such as paper and plastic, among others.

The invention also relates to an adjustable transfer roll for handling said laminar elements and particularly to a rotating transfer roll with a cylindrical surface provided with pneumatic means for holding laminar elements coming from a supply device thereon and delivering them to a receiving device.

STATE OF THE PRIOR ART

Different devices used for continuously creating stacks of laminar products are known. The laminar elements, such as, for example, labels, leaflets, loose sheets, etc., are supplied by a feed system to the upper part of a roll which is actuated to rotate in relation to a generally horizontal shaft. The roll includes means for temporarily holding the laminar elements until they reach a lower part of the roll, where they are separated by a barrier. The separated laminar elements fall on a stacking support where a stack is formed.

Patent application US 2003/0082044 describes a device of this type in which the roll is formed by a plurality of equidistantly separated wheels rotating in unison in relation to a common shaft. Each wheel has a plurality of spirally-shaped fingers arranged such that they partially overlap one another and which are provided for holding a laminar element between every two fingers. According to an embodiment, two separating members are alternately interposed between two of the laminar elements such that the lower element of said two elements is the last element of a stack and the upper element of said two elements is the first element of the next stack, which is formed on the separating member. During the stack formation, the separating member supporting it moves as it grows, while the other separating member deposits the previous finished stack on output conveyor means and then it moves out of the stacking area to be located in a suitable position for being positioned, when it is its turn, between two laminar elements and thus beginning a new stack thereon.

According to another embodiment of mentioned patent application US 2003/0082044, only one separating member is incorporated and the output conveyor means are adapted for moving up and down in a stopped condition so as to act as a support for the stacks being formed. Thus, the output conveyor means first move upwards to receive the stack which is formed on the separating member, which is released to be moved out of the stacking area and be located in a suitable position so as to be positioned at the appropriate time between two laminar elements. The output conveyor means move downwards as the stack is being formed. When the separating member is positioned between two laminar elements, a finished stack is arranged on the output conveyor means, the output conveyor means are set in motion to remove the stack, and a new stack is initiated on the separating member.

In the first of the two embodiments, the two separating members are provided with combined movements in two directions requiring considerably complicated mechanisms, with the drawback of making the device complex and expensive to manufacture and to maintain. In the second embodiment, the single separating member is also provided with movements in two directions, and the output conveyor means are provided with up and down movements, which is also considerably complex. In addition, this embodiment has the drawback that the formed stacks are relatively "loose", given that means for pressing against the elements of the stack as it is being formed for the purpose of eliminating as much as possible any air between them are not provided.

Other background documents from the prior art relating to this type of device are described in patent documents EP-B-548216, EP-A-0561100, U.S. Pat. Nos. B-6,581,927, B-6,832,886 and B-6,877,740.

European patent EP-A-0579985 discloses a device for applying thin film labels on small cylindrical articles. The device comprises a label transporting drum having an internal cylindrically configured hub and a cylindrical drum rotatably assembled on said hub, with means for rotating the drum on said hub. A device is adapted to supply a label on the surface of said drum. Multiple vacuum slots defining a circumferential label holding area and multiple pressure slots circumferentially aligned after said multiple vacuum slots are radially extended around a substantial part of the circumference of the hub. Valve port means communicating with the surface of said drum are arranged on the inner surface of said drum. The mentioned label holding area is adapted to receive the vacuum provided from said multiple vacuum slots to hold the label on the surface of said drum, while at the same time said label moves through said label holding area, which is also adapted for receiving pressure from said multiple pressure slots to release the front edge of the label until it is placed in contact with an article located in the appropriate position for applying the label to the article.

European patent EP-A-1037829 describes a device for the transfer of segregated flat-shaped products, especially patches, labels or stamps, onto a transport device comprising a transport device and a transfer device for the ordered feeding of said products to the said transport device. The transfer device comprises a roll with suction orifices arranged at the circumference thereof which are supplied with negative pressure via a groove with a vacuum system, and which, after a partial revolution, are supplied with air via a ventilation channel. The roll is arranged transversely to the transport device, and the respective suction orifices connected with the ventilation channel facing towards the transport device in each case and being able to be moved in front the same.

In the embodiments of the last two patents mentioned, it is not possible to selectively open or close communication between selected groups of suction orifices and the vacuum or blowing system.

DISCLOSURE OF THE INVENTION

The present invention contributes to solving the aforementioned and other drawbacks by providing a device for unloading laminar elements from a transfer roll, and for forming and transferring stacks of such laminar elements, characterized in that it comprises a barrier located in the path of said laminar elements when they are transported by said roll, for unloading the laminar elements from the roll in an unloading area; a support for receiving in a stacked manner laminar elements unloaded and detained by said barrier, forming a growing stack; a separator adapted for being moved from a retracted position to an extended position interposed between first and second adjacent laminar elements, where said first laminar element completes a finished stack on said support and said second laminar element is momentarily held by said separator in order to begin a new growing stack while said finished stack is taken off the support; and a push element adapted for being moved from a retracted position to an extended position for pushing the finished stack and transferring it from the support to an outlet support.

The previously mentioned members of the device are provided with linear movements which can be easily actuated by linear actuators, such as fluid dynamic cylinders, electric motors with nut and screw mechanisms, linear electric motors, among others.

The device comprises support actuation means adapted to move the support receiving the stacked laminar elements away from said unloading area at a speed according to a corresponding growing speed of the growing stack and maintaining a predetermined pressure between a last laminar element of the growing stack and a cylindrical surface of the roll, being in contact. With this, air is substantially prevented from being trapped between the laminar elements of the stack being formed, making the stack more compact and furthermore the transfer from the roll to the upper part of the stack is carried out in a controlled manner at all times and without damaging the laminar elements. To control the mentioned predetermined pressure, the device incorporates a position detecting arrangement associated to the mentioned support of the stack of laminar elements and a member suitable for exerting a substantially regular pressure against the support to push the stack of laminar elements against the periphery or cylindrical surface of the transfer roll. Said position detecting arrangement is connected with control means controlling support actuation means moving the support downwards as a stack of laminar elements is being formed thereon and such that a predetermined pressure of said stack against the surface of the roll is always maintained.

The support actuation means are further adapted to move the support, once the positioning of the separator to its extended position has completed the finished stack, away from said unloading area until placing it at the level of said outlet support and, once the finished stack is pushed off, bringing the support closer to the separator again to receive the growing stack therefrom. These movements for moving the stack away and bringing it closer are carried out at a greater speed than the growing speed of the growing stack on the separator, which gives time to receive the growing stack in the support when the stack is in an initial stage of its formation. Likewise, the time taken by the growing stack to be finished on the support is enough to allow the removal and repositioning of the separator.

The present invention also provides a method suitable for being carried out by the device of the invention described above. The method is characterized in that it comprises the steps of unloading the laminar elements from the roll in an unloading area with the aid of a barrier located in the path of said laminar elements when they are transported by said roll; receiving by means of a support stacks of the laminar elements unloaded and detained by said barrier forming a growing stack; moving a separator from a retracted position to an extended position interposed between first and second adjacent laminar elements, where said first laminar element completes a finished stack on said support and said second laminar element is momentarily held by said separator in order to begin a new growing stack whereas said finished stack is taken off the support; and pushing the finished stack and transferring it from the support to an outlet support by means of a push element adapted for being moved from a retracted position to an extended position.

The method comprises moving the support by means of support actuation means away from said unloading area at a speed according to a growing speed of the growing stack, preferably maintaining a predetermined pressure between a last laminar element of the growing stack and a cylindrical surface of the roll by using said support actuation means for the purpose of substantially preventing the presence of air between the laminar elements and ensuring a regular transfer from the roll to the upper part of the stack, without damaging said laminar elements.

The invention also contemplates the use of a rotating transfer roll with a cylindrical surface provided with holding means for holding thereon laminar elements coming from a supply device and delivering them to a receiving device, like the one described, for unloading and forming stacks of laminar elements and transferring such stacks. Such holding means comprise orifices in rows that are substantially parallel to the shaft of the roll and distributed at angular intervals in said cylindrical surface; inner ducts each of which is communicated to those orifices forming at least one of said rows and with an entrance; suction or blowing means in communication with the inner ducts through their entrances along at least a part of the rotation of the roll to apply a suction or blowing flow through the orifices for the purpose of holding the laminar elements by suction or releasing them by blowing, respectively, and shutting means to selectively allow or prevent said suction/blowing flow through the orifices for the purpose of adjusting the roll to laminar elements of different sizes.

The transfer roll of the present invention is characterized in that said shutting means comprise a shutter device associated to each inner duct, each shutter device being configured and arranged to be changed between an open position, in which it allows a flow between the inner duct and the suction means, and a closed position, in which it prevents said flow between the inner duct and the vacuum or blowing means.

With this arrangement it is possible to open or close all the orifices belonging to each line by means of the actuation of a single shutter device, which entails considerable savings in time and money. Furthermore, each of the shutter devices comprise a valve body retained in a housing transverse to the corresponding inner duct and adapted to rotate in said housing between said open and closed positions. Each valve body can be individually accessed from outside the roll by means of a tool to be selectively placed in said open position or in said closed position. The proliferation of loose parts, such as individual stoppers in the devices of the prior art, is thus prevented. To prevent an unwanted movement of the valve bodies inside their respective housings, means for fixing the angular position of each valve body inside its corresponding housing, both in the open position and in the closed position, have been provided.

BRIEF DESCRIPTION OF THE DRAWINGS

The previous and other features and advantages of the present invention will be more fully understood form the following detailed description of several exemplary embodiments with reference to the attached drawings, in which.

DETAILED DESCRIPTION OF EXEMPLARY EMBODIMENTS

Figure 1:
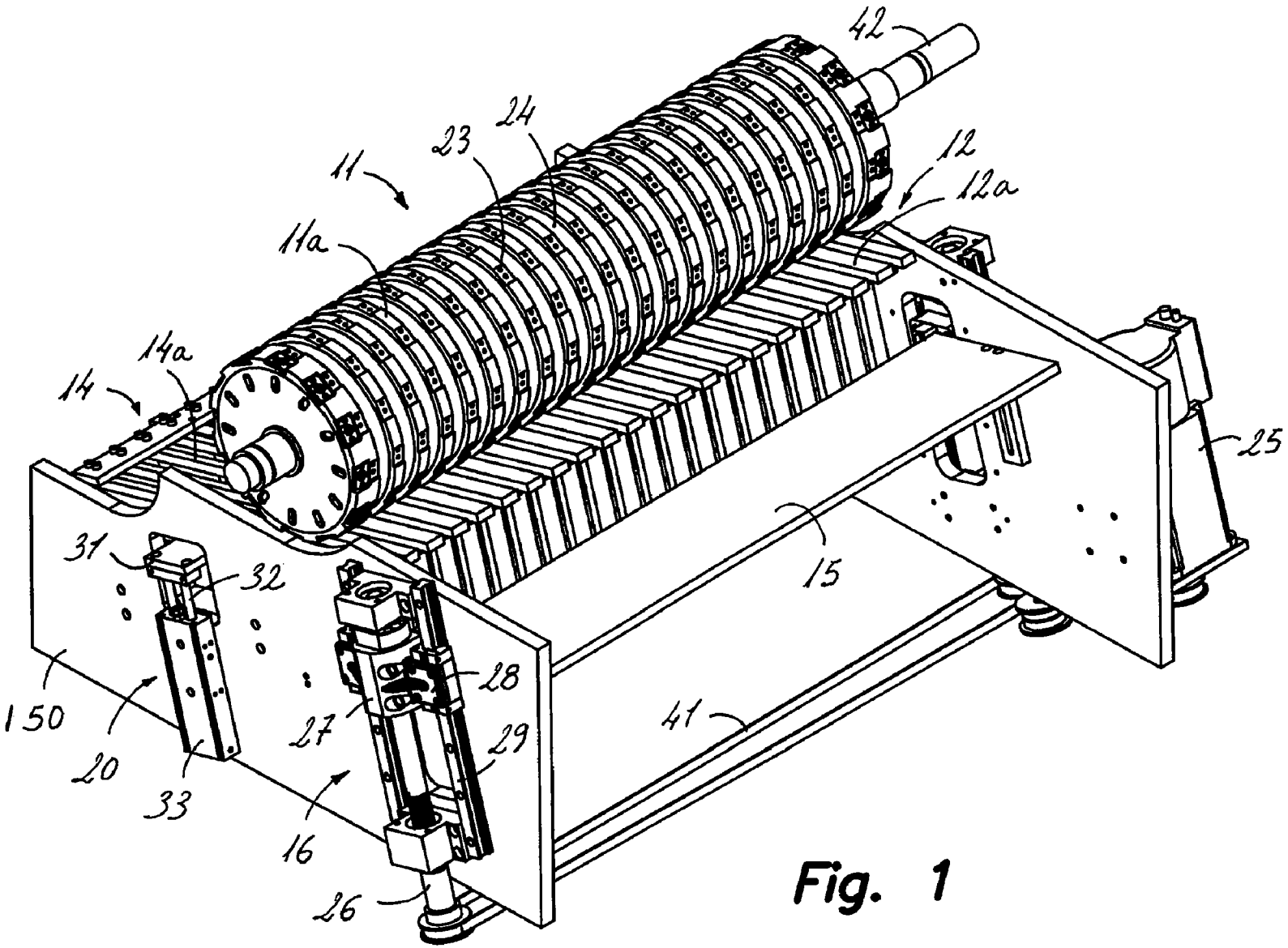
FIG. 1 shows a perspective view of the device for unloading laminar elements from a roll, and forming and transferring stacks of such laminar elements according to an exemplary embodiment of the present invention.
Figure 2:
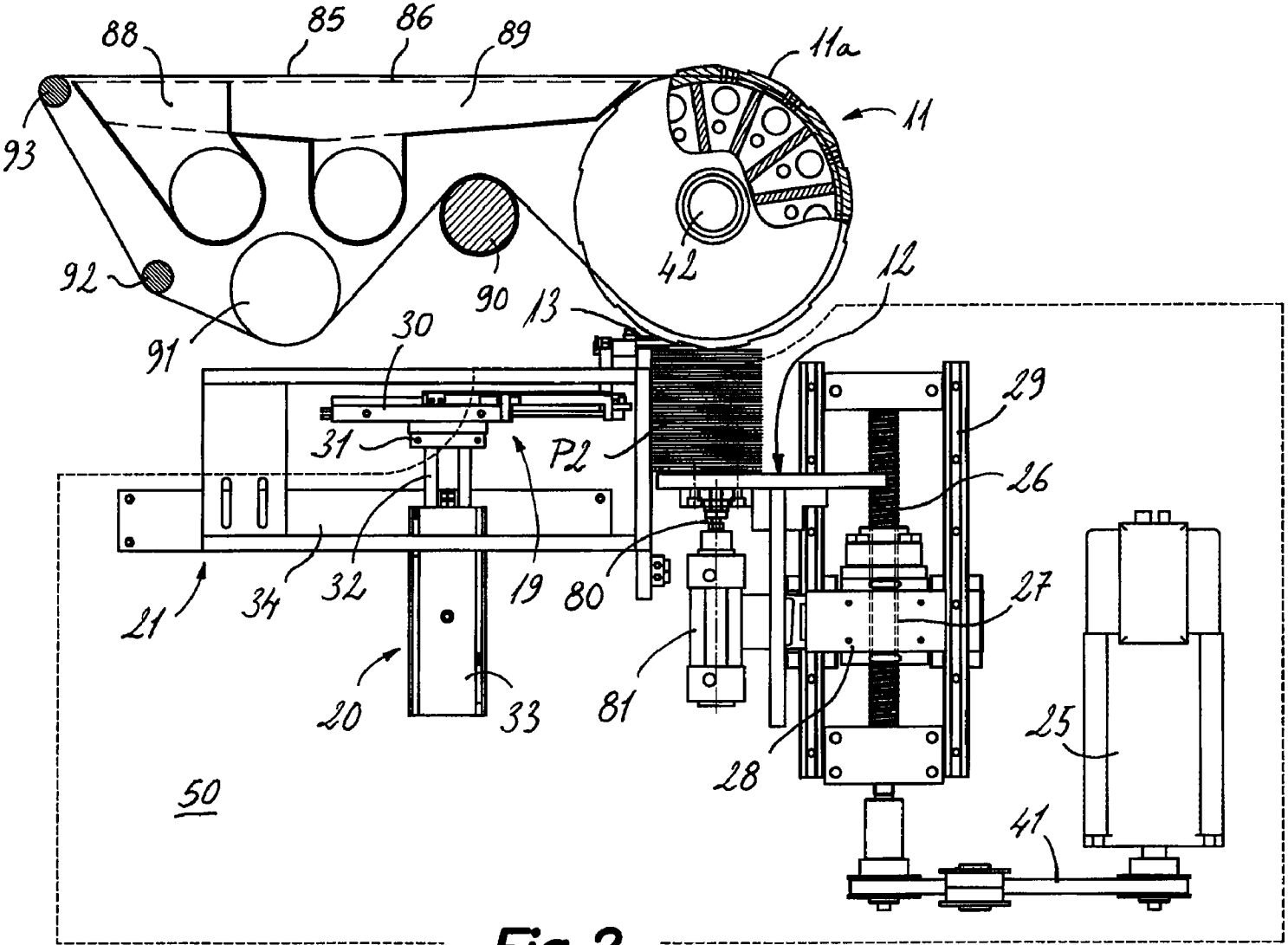
FIG. 2 is a side view of the device of FIG. 1.
Figure 3:
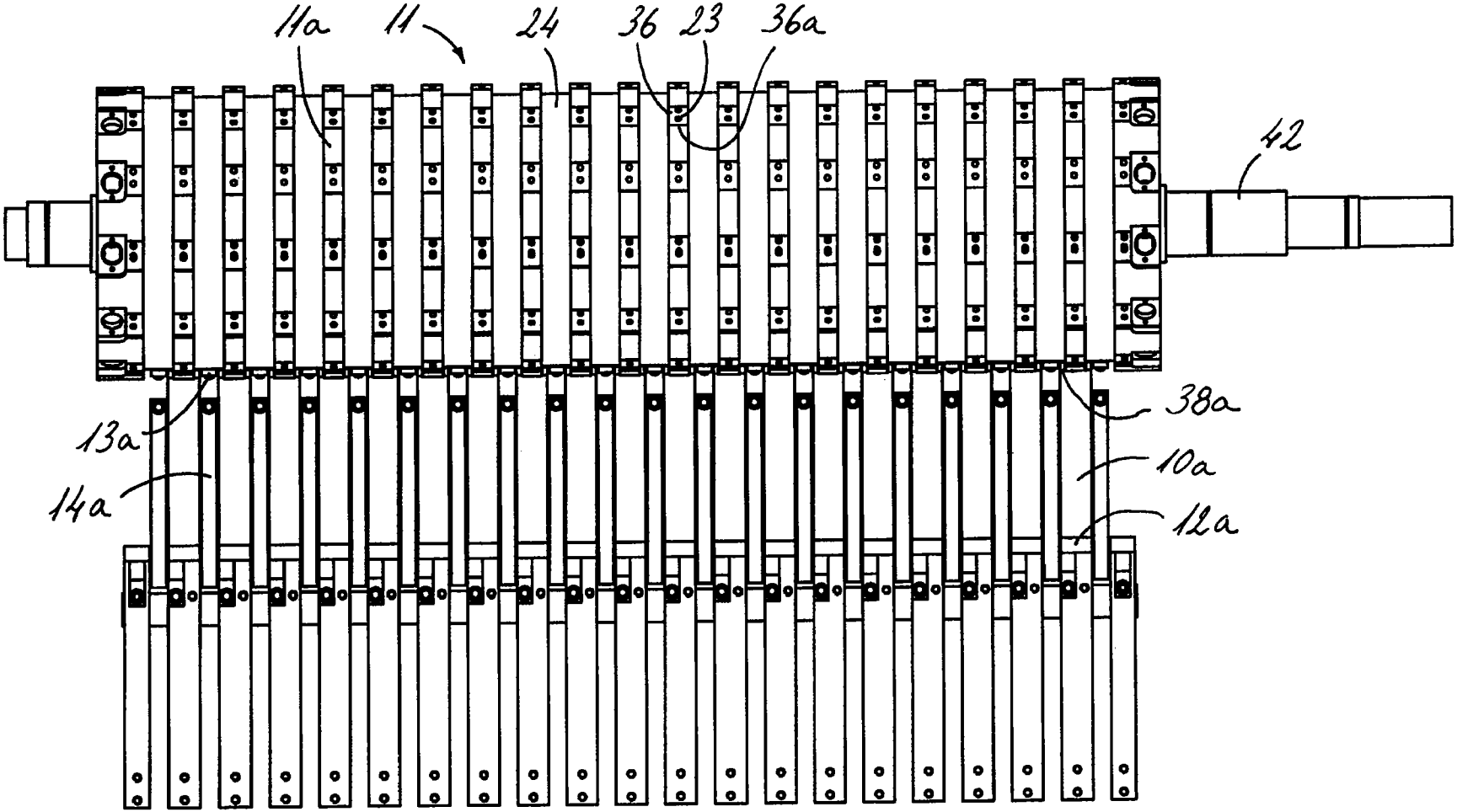
FIG. 3 is a front view of the device of FIG. 1, from which the frame has been omitted for the sake of greater clarity.

With reference first to FIGS. 1 to 3, a device according to an exemplary embodiment of the present invention is described, which comprises a roll 11 arranged and actuated to rotate with respect to a substantially horizontal shaft 42. The roll 11 comprises a cylindrical surface 11*a* in which there are a plurality of orifices 23 prepared to be connected to a low pressure source to hold by suction the laminar elements L on the roll 11 along a part of their rotation path between a receiving area associated to a supply device 43 for supplying laminar elements L (FIGS. 6A-6F) generally located at an upper part of the roll 11, and an unloading area which is generally at the lower part of the roll 11. The mentioned suction orifices 23 are ordered in rows parallel to the shaft 42 of the roll and in circumferential lines perpendicular to the shaft 42 of the roll. Inner ducts 40 (indicated by means of dotted lines in FIG. 5) connect all the suction orifices 23 belonging to one or more of said roes with the mentioned low pressure source. There are ring-shaped grooves 24 arranged in said cylindrical surface 11*a* of the roll 11 and between said circumferential lines of suction orifices 23. As better shown in FIG. 5, the orifices 23 are open at recessed surfaces 36, each of which forms a step 36*a* with the cylindrical surface 11*a* in its front end and converges with the cylindrical surface 11*a* at its rear end (considered with respect to the rotation direction). The mentioned ring-shaped grooves 24 are deeper than said step 36*a*, and their function will be explained below.

In the mentioned unloading area, the device comprises a stationary barrier 10 located in the path of said laminar elements L when they are transported by said roll 11. When they reach the barrier 10, the suction orifices 23 of the roll 11 are disconnected from the suction means (and eventually connected to a blowing source before reaching said barrier) and the barrier 10 acts to unload the laminar elements L from the roll 11 in said unloading area. Next to the barrier 10 there is a support 12 arranged to receive thereon stacks of the laminar elements L unloaded and detained by said barrier 10. The laminar elements L are thus accumulated in stacks on the support 12 forming a growing stack P2. As better shown in FIGS. 6A to 6F, the barrier 10 and the support 12 are orthogonal to one another.

Figure 6A:
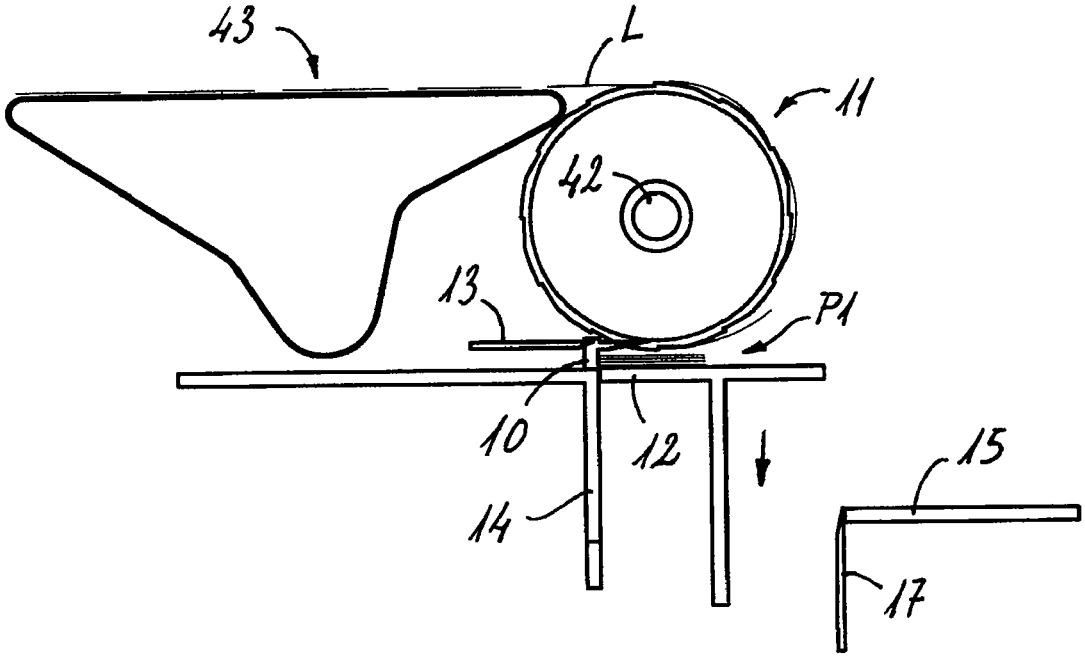
FIGS. 6A to 6F are schematic elevation views illustrating a sequence of steps followed by the method of the present invention using a device like that of FIG. 1.
Figure 6B:
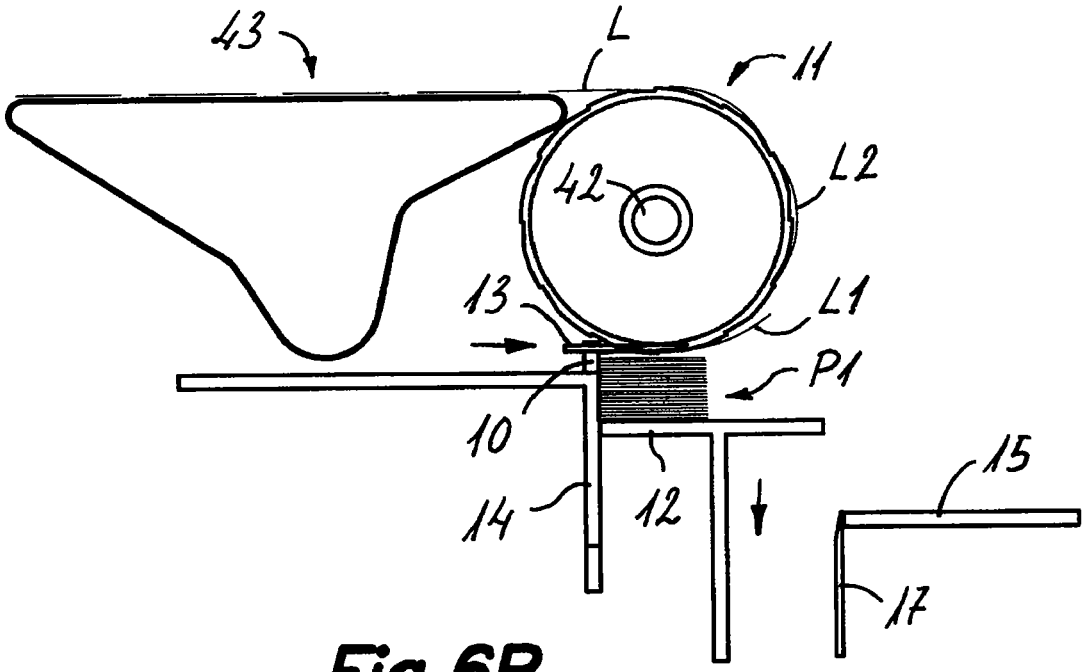
Figure 6C:
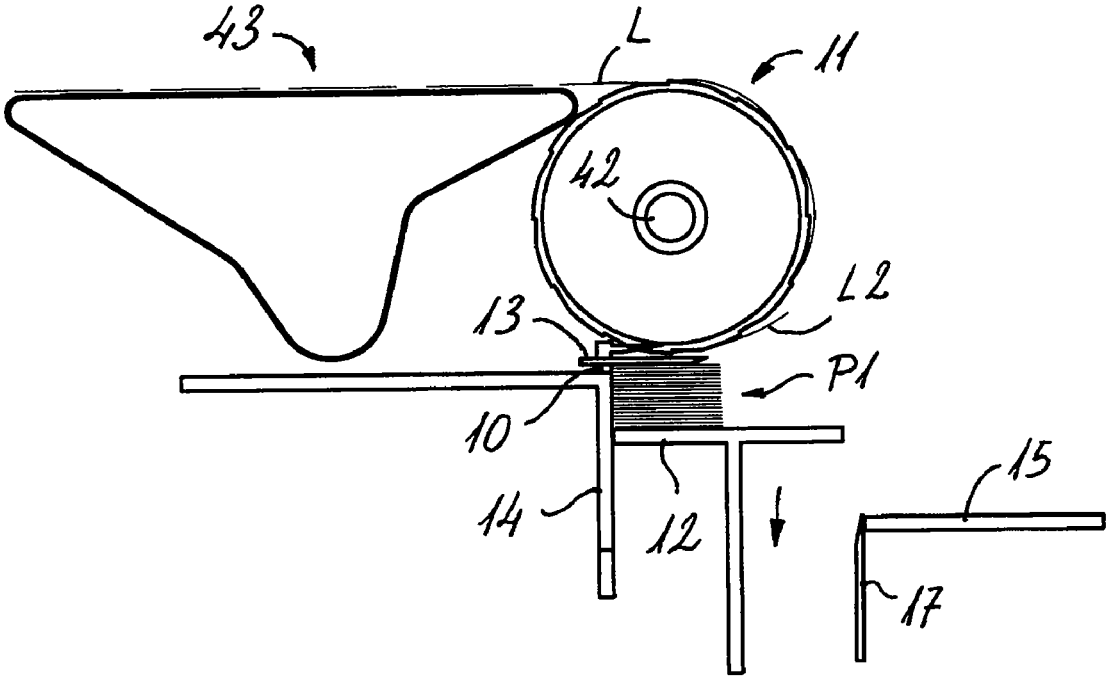

The device includes a separator 13 adapted for being moved from a retracted position (FIG. 6A), in which the separator is away from the roll and out of interference, to an extended position adjacent to the roll (FIG. 6B), in which the separator 13 is inserted in the ring-shaped grooves 24 interfering with the path of the laminar elements transported by the roll, such that a first laminar element L1 reaching the unloading area is located under the separator 13. Then, the separator is quickly moved a short distance in the direction of the barrier 10 from said extended position adjacent to the roll (FIG. 6B) to an extended position separated from the roll (FIG. 6C). Thus, when the rotation of the roll makes a second laminar element L2 (following the first laminar element L1) reach the unloading area, the separator 13 is positioned between said adjacent first and second laminar elements L1, L2, such that said first laminar element L1 completes a finished stack P1 on said support 12 and said second laminar element L2 is momentarily held by said separator 13 in order to begin a new growing stack P2 whereas said finished stack P1 is taken off the support 12.

Finally, the device comprises a push element 14 adapted for being moved from a retracted position (FIGS. 6A to 6D and 6F), in which the push element is out of interference, to an extended position (FIG. 6E) carrying out a path during which the push element pushes the finished stack P1 until transferring it from the support 12 to an outlet support 15. Preferably, next to said outlet support 15 there is arranged a retainer 17 adapted for being moved from a retracted position (FIGS. 6A to 6E), in which the retainer is out of interference, to an extended position (FIG. 6F) in which the retainer retains the finished stack P1 on the outlet support 15 when said push element 14 is again moved to its retracted position.

According to an exemplary embodiment (FIG. 2), support actuation means 16 are in charge of carrying out movements of the support 12 away from said unloading area or bringing it closer thereto at different speeds. An example of such support actuation means 16 comprises an electric motor 25 connected by means of a transmission 41 to rotate a pair of twin nut and screw mechanisms arranged on the sides of a frame 150 of the device. Each of such mechanisms comprises a screw 26 coupled to a nut 27 fixed to a mobile support 28 guided linearly by a pair of guides 29 mounted to the frame 150. The support 12 is fixed at its ends to both mobile supports 28. The described support actuation means 16 obviously allow several variations. It is essential that the actuation motor or motors can be electrically or electronically controlled and the mechanisms transmit the movements of the motor with sufficient precision.

Thanks to the above, during the formation of the stack, the support actuation means 16 move the support 12 away from said unloading area at a speed according to the growing speed of the growing stack P2, which will depend on different factors, such as the rotation speed of the roll, the size of the labels (i.e. the number of labels which fit in a certain portion of the surface of the roll), and the thickness of the labels. Once the finished stack P1 is completed, i.e. once the separator 13 has moved to its extended position (FIG. 6B), these same support actuation means 16 are adapted to move the support 12 away from said unloading area until placing it at the level of said outlet support 15, at a speed greater than said growing speed of the growing stack P2 on the separator 13. The separator is also adapted for being moved to a distance from said unloading area while the growing stack is formed thereon.

Once the finished stack P1 has been transferred to the outlet support 15 by means of the movement of the push element 14, the support actuation means 16 are adapted to move the support 12 bringing it closer to said unloading area at a speed greater than the speed at which the growing stack P2 grows on the separator. This allows the support 12 to receive the growing stack P2 in an initial stage of its formation when the separator 13 is again moved to its retracted position (FIG. 6F).

Said FIG. 2 also shows an exemplary embodiment of an arrangement allowing the support actuation means 16 to move the support 12 during the growth of the stack thereon maintaining a predetermined pressure between a last laminar element L of the growing stack P2 and the cylindrical surface 11*a* of the roll 11 for the purpose of preventing the presence of air between the laminar elements and obtaining more compact stacks as well as ensuring a controlled transfer at any time of the laminar elements at the top of the stack being formed, without damaging them. Said arrangement comprises the linkage of the support 12 to a rod 80 of a piston housed inside a cylinder 81 containing a compressible fluid, the casing or body of which is attached to the mentioned mobile support 28 actuated by the electric motor 25. The growth of the stack P2 being formed on the support 12 determines the movement of the rod towards the inside of the cylinder 81 (as the body of the cylinder and the support 28 do not move) and the compression reaction of the fluid at one side of the piston of said cylinder determines a pressure keeping the stack compressed against the periphery of the cylinder according to a predetermined value. A position detector associated to the cylinder 81 is prepared to send a signal to control means controlling a motor 25 to activate said motor and move the support 12 downwards when the rod 80 reaches a certain degree of insertion in the cylinder 81, said rod 80 then recovering, when the body of the cylinder 81 together with the support 28 move downwards, a position towards the outside and maintaining a predetermined pressure against stack P2, pushing it towards the periphery of the cylinder 11. The activation signal can alternatively be generated by means of a pressure detector associated to the chamber of the cylinder 81 that is compressed. In this manner, the motor 25 moves the mobile support 28 together with the support 12 regularly downwards, step by step, maintaining a uniform compression having a predetermined magnitude of the stack P2 of laminar elements being formed against the periphery of the roll 11.

Figure 6D:
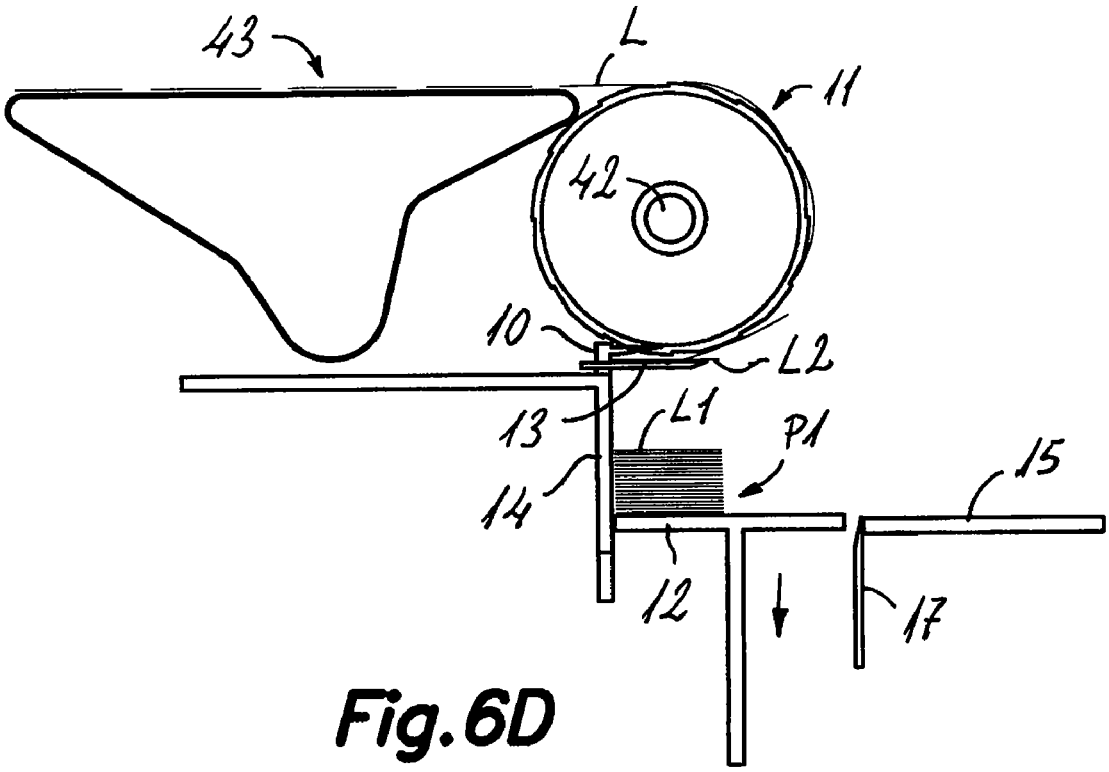
Figure 6E:
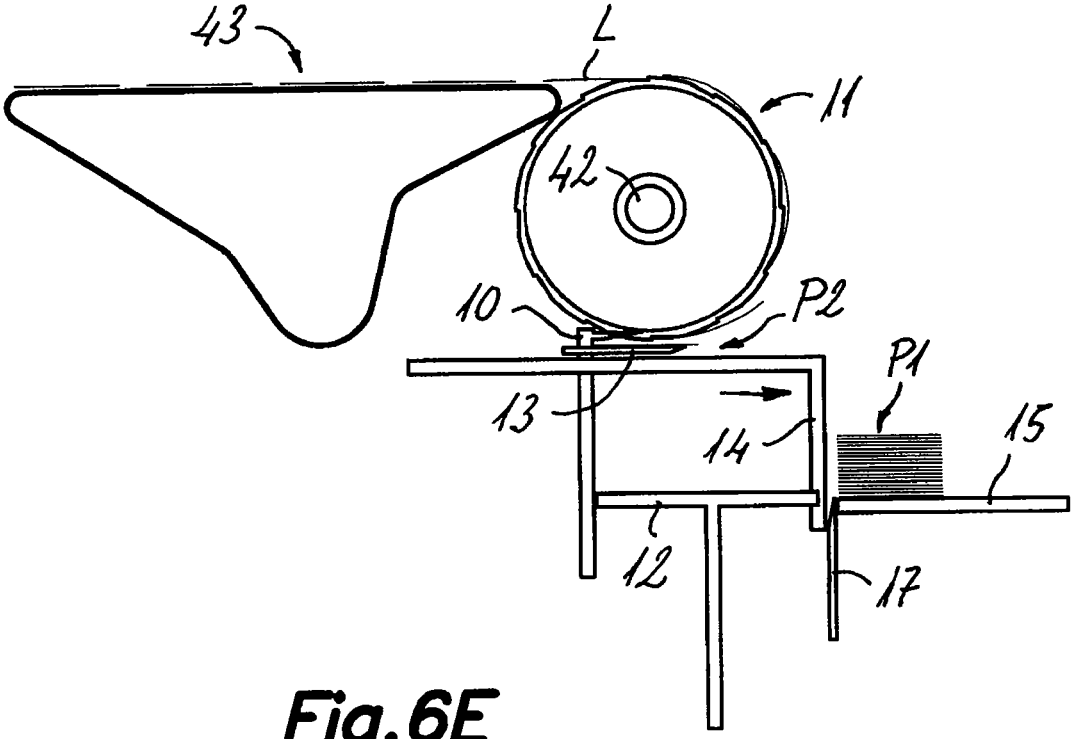
Figure 6F:
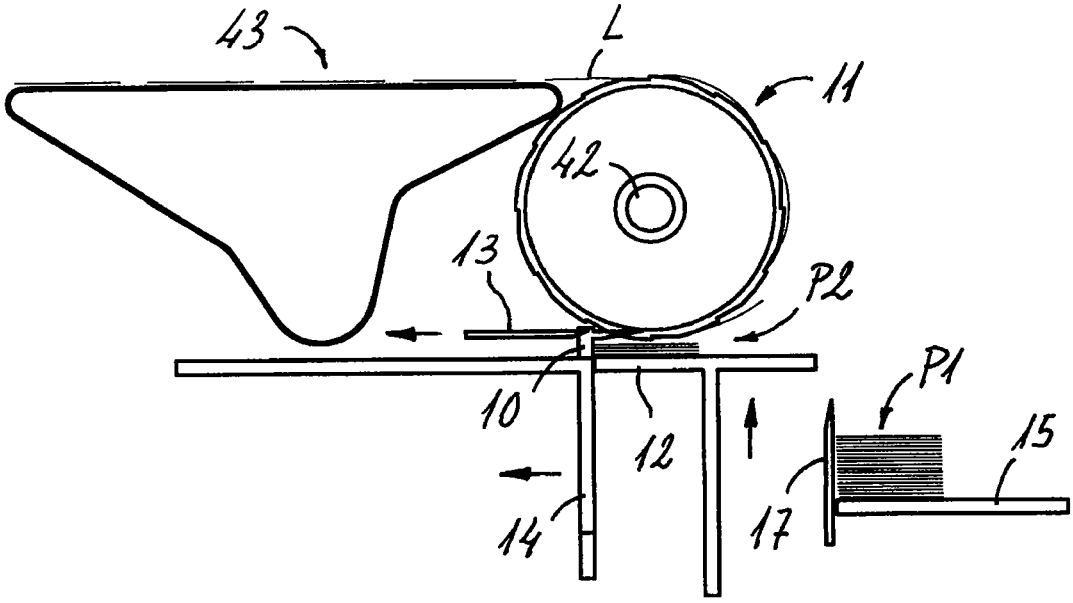

As described above, the separator 13 is provided with first movements between its retracted and extended positions and with second movements in a direction substantially parallel to the barrier 10 between a position adjacent to the roll 11 (FIGS. 6A, 6B and 6F) and a position separated from the roll 11 (FIG. 6C to 6E). To that end, the device comprises first separator actuation means 19 to actuate the first movements of the separator 13 between its retracted and extended positions and second separator actuation means 20 to actuate the second movements of the separator 13 between its positions adjacent to and separated from the roll 11. The separator 13 is preferably mounted to be moved by said first separator actuation means 19, and the first separator actuation means 19 together with the separator 13 are mounted to be moved by said second separator actuation means 20.

As better shown in FIG. 2, the first separator actuation means 19 comprise, at each side of the frame 150, a linear actuator 30 with a mobile part fixed to the separator 13 and a fixed part mounted on a mobile support 31 connected to at least one mobile part 32 of a linear actuator 33 the fixed part of which is connected to the frame 150 and which forms part of the second separator actuation means 20. Given that the first and second movements of the separator 13 must be relatively fast and do not require stops in intermediate positions, pneumatic cylinders are suitable for carrying out the functions of said linear actuators 30 and 33, although other types of linear actuators such as hydraulic cylinders, electric motors with nut and screw mechanisms, linear electric motors, etc. are not ruled out. Guide means cooperating with the first and second separator actuation means 19, 20 are incorporated for guiding the first and second movements. With this arrangement, the separator 13 can move between four positions, namely: retracted and close to the roll (FIG. 6A); extended and close to the roll (FIG. 6B); extended and separated from the roll (FIGS. 6C to 6E); and retracted and separated from the roll (FIG. 6F).

On the other hand, push element actuation means 21 are in charge of the movements of said push element 14 between its retracted and extended positions, said push element actuation means 21 comprising for example, at each side of the frame 150, a linear actuator 34 having a mobile part fixed to the push element 14 and a fixed part connected to the frame 150. The movements of the mentioned retainer 17 between its retracted and extended positions are carried out by means of retainer actuation means comprising a linear actuator (not shown) on each side of the frame 150, with a fixed part mounted thereto and a mobile part connected to the retainer 17. In this case, pneumatic cylinders are also suitable to carry out the functions of linear actuators, without this being a limitation. The movements of the push element 14 and the retainer 17 are guided by corresponding guide means cooperating with the push element and retainer actuation means.

Specially referring now to FIG. 3, the barrier 10 is formed by a plurality of barrier fingers 10*a* arranged aligned with the circumferential lines of orifices 23 of the roll 11 such that regularly distributed separating spaces are formed between said barrier fingers 10*a*. The separator 13 comprises a plurality of separator fingers 13*a* adapted to be introduced inside the ring-shaped grooves 24 of the roll 11 through said separating spaces between the barrier fingers 10*a* when the separator 13 is moved from its retracted position to its extended position. The mentioned second movements of the separator 13 between its positions adjacent to the roll 11 and separated from the roll 11 are also carried out with the separator fingers 13*a* in the separating spaces between the barrier fingers 10*a*.

Figure 5:
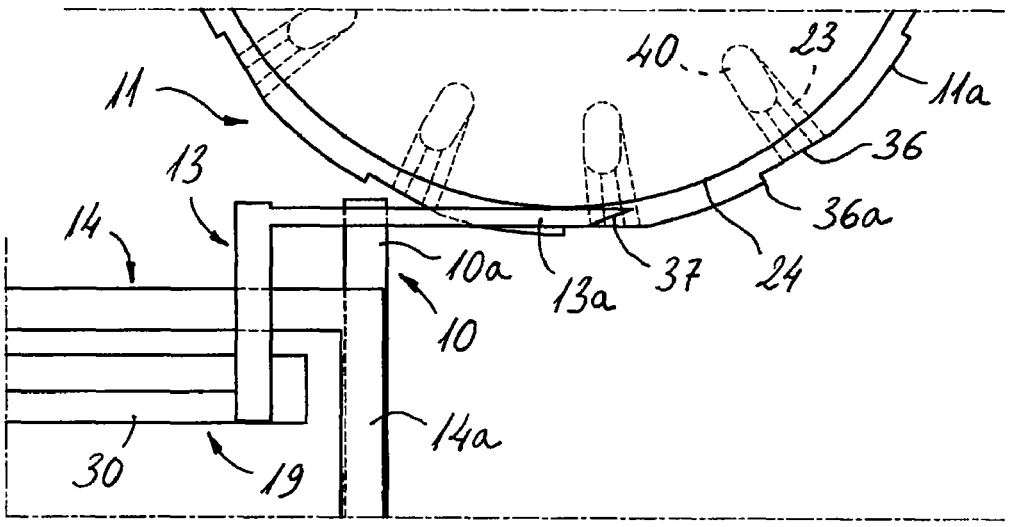
FIG. 5 is a side view of an enlarged detail showing a separator in relation with a roll in the device of FIG. 1.

As shown with more detail in FIG. 5, each of the separator fingers 13*a* has a wedge end 37 which is located close to a bottom of the corresponding ring-shaped groove 24, in a position deeper than the steps 36*a*, when the separator is in its extended position close to the roll. With this it is ensured that the first laminar element L1 is located at the lower part of the separator fingers 13*a*. One fast movement of the separator 13 from this extended position close to the roll to its extended position separated from the roll assures that the next reaching second laminar element L2 is located at the upper part of the separator fingers 13*a* and is separated from the roll by the diverting prong 38, described previously and shown in FIG. 5. To that end, the diverting prong 38 has a similar wedge construction, although it is stationary and is formed by a plurality of prong fingers 38*a* (FIG. 3) associated to the barrier fingers 10*a* of the barrier 10. The prong fingers 38*a* and the separator fingers 13*a* are advantageously sized so as to share the available space inside the ring-shaped grooves 24 of the roll 11.

The support 12 also comprises a plurality of support fingers 12*a* arranged aligned with the barrier fingers 10*a* and substantially perpendicular thereto. These support fingers 12*a* are adapted to be moved along the separating spaces between the barrier fingers 10*a* when the support 12 is moved from the unloading area to the level of said outlet support 15, and vice versa. The push element 14 also comprises a plurality of push element fingers 14*a* adapted to pass through the separating spaces between said barrier fingers 10*a* and through corresponding separating spaces formed between said support fingers 12*a* when the push element 14 is moved from its retracted position to its extended position. Likewise, the retainer 17 is also formed by a plurality of retainer fingers adapted to pass between said push element fingers 14*a* when the retainer 17 is moved to its extended position.

With this arrangement, the support 12, the separator 13, the push element 14 and the retainer 17 can carry out their movements without interfering with one another or with the stationary barrier 10.

The method for unloading laminar elements from a roll, and forming and transferring stacks of such laminar elements according to the present invention is described below with reference to FIGS. 6A to 6F. The method first comprises unloading the laminar elements L from the roll 11 in an unloading area with the aid of a barrier 10 located in the path of said laminar elements L when they are transported by said roll 11. Then, receiving by means of a support 12 stacks of the laminar elements L unloaded and detained by said barrier 10 forming a growing stack L2 (FIG. 6A). When the stack has reached the desired size, moving a separator 13 from a retracted position to an extended position separated from the roll, the separator 13 being interposed between first and second adjacent laminar elements L1, L2 (FIGS. 6B to 6D), where said first laminar element L1 completes a finished stack P1 on said support 12 and said second laminar element L2 is momentarily held by said separator 13 in order to begin a new growing stack P2 while said finished stack P1 is taken off the support 12. Then, moving the support 12 to the level of an outlet support 15 and pushing the finished stack P1 to transfer it from the support 12 to said outlet support 15 by means of a push element 14 adapted for being moved from a retracted position to an extended position (FIG. 6E). Finally, moving the support 12 to the level of the separator 13 and removing the separator 13 to its retracted position (FIG. 6F) to transfer said new growing stack P2 from the separator 13 to the support 12, thus starting a new cycle.

The method of the invention also comprises moving the support 12 by means of support actuation means 16 away from said unloading area at a speed according to a growing speed of the growing stack P2 and, preferably maintaining a predetermined pressure between a last laminar element L of the growing stack P2 and a cylindrical surface 11*a* of the roll 11 using said controlled support actuation means 16.

Figure 4:
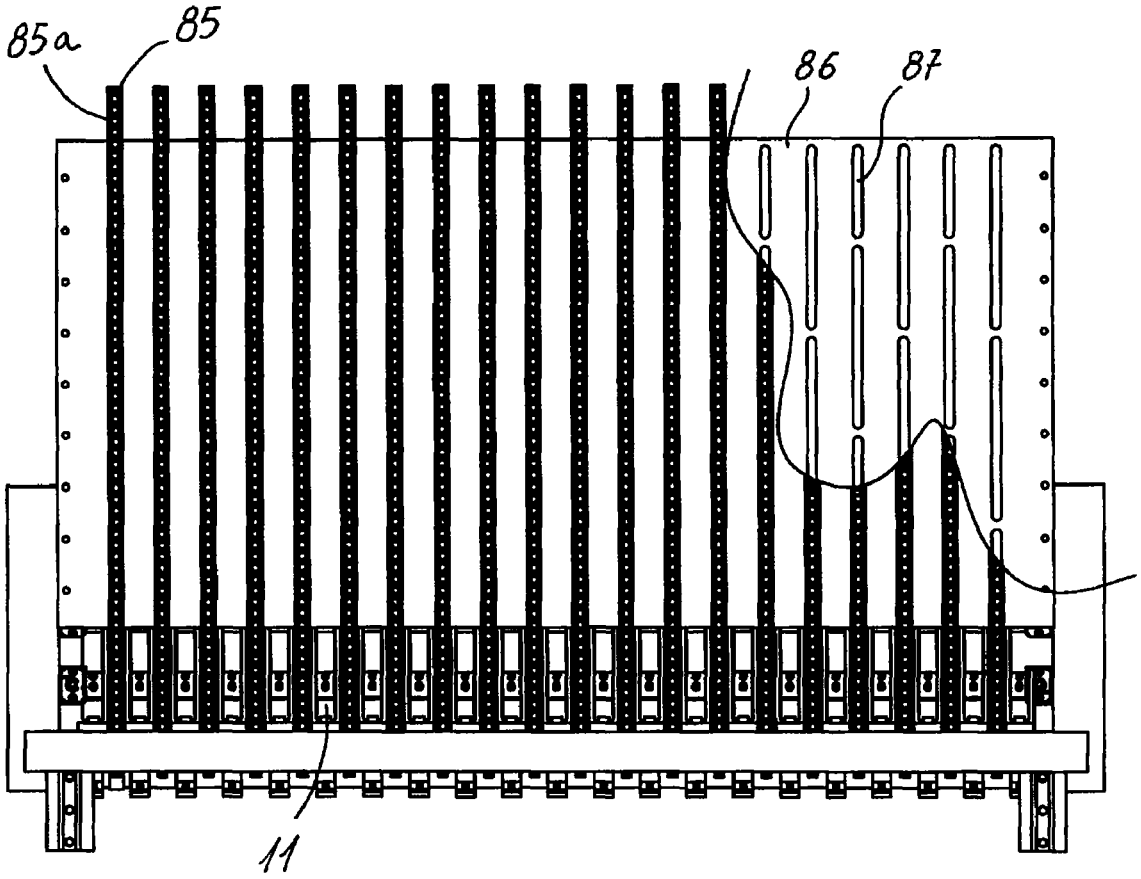
FIG. 4 is a plan view of the supply device for supplying laminar elements associated to the transfer roll.

FIGS. 2 and 4 show means for feeding the laminar elements towards the transfer roll 11. Such means comprise a plurality of belts 85 guided by roller system 90, 91, 93, having a plurality of perforations extending on a floor 86 provided with a series of elongated openings 87 on which the belts move. Said elongated openings are communicated with differentiated suction chambers 88, 89 such that a greater suction can be generated in a first area (chamber 88) close to a formation area of the laminar elements, for example, by cutting the laminar elements, and a smaller suction can be generated in a second area (chamber 89) close to the passage area on the transfer roll 11. The mentioned belts 85 also surround the mentioned roll, being arranged inside the mentioned grooves 24, and the laminar elements passing to be held by the orifices 23 of said roll, as explained previously.

Figure 7:
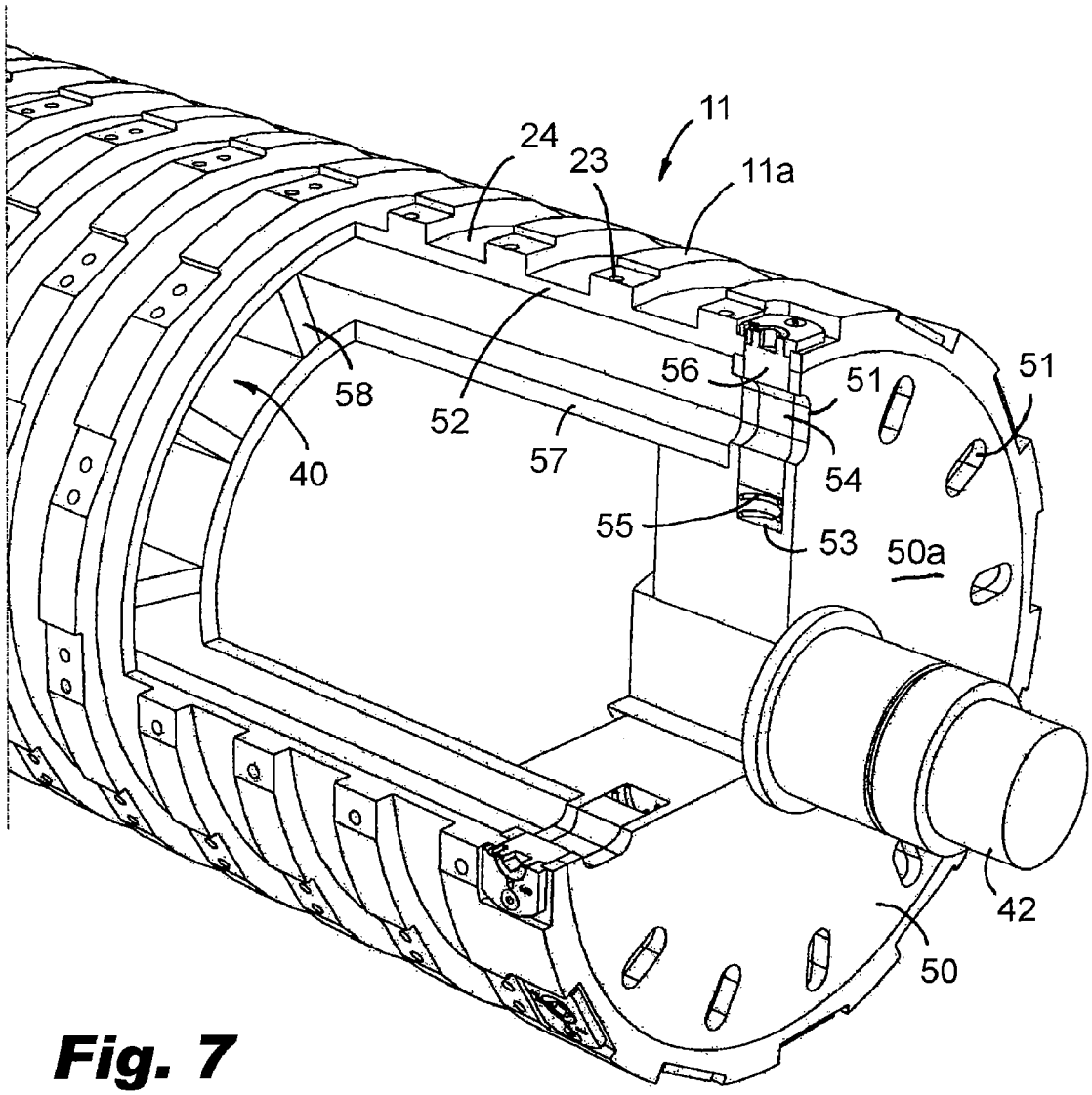
FIG. 7 shows a partially sectioned perspective view of a transfer roll according to an exemplary embodiment of the present invention.

FIG. 7 shows a transfer roll 11 according to an exemplary embodiment, which roll is suitable for handling laminar elements and is therefore applicable to the device according to the present invention. The mentioned transfer roll 11 is rotatable and comprises a pair of circular end parts 50 (only one of which is shown in FIG. 7), with a central part in which stub shafts 42 are fixed. An outer cylindrical tube 52 defining a cylindrical surface 11*a* provided with a series of parallel circumferential grooves 24 is mounted on peripheral parts of the end parts 50. Orifices 23 arranged in rows substantially parallel to the shaft of the roller 11 are arranged in a recessed surface of said cylindrical surface 11*a*. The mentioned rows are distributed at angular intervals in the cylindrical surface 11*a*.

An inner cylindrical tube 57 having an outer surface at a distance from the inner surface of the outer cylindrical tube 52 is arranged in inner steps of the end parts 50. Partitions 58 extending from one end of the roll 11 to the other are radially arranged between said outer surface of the inner cylindrical tube 57 and said inner surface of the outer cylindrical tube. The mentioned partitions 58 together with the outer and inner cylindrical tubes 52, 57 define inner ducts 40, each of which is communicated with the orifices 23 forming at least one of said rows of orifices 23. In the illustrated embodiment, each inner duct 40 communicates with two rows of orifices 23. In at least one of the end parts 50 there is a plurality of openings 51 distributed at angular intervals such that each of said openings 51 communicates with a corresponding duct of said inner ducts 40. Each inner duct 40 thus has an entrance 51 in an outer end surface 50*a* of one of the end parts 50.

Figure 10:
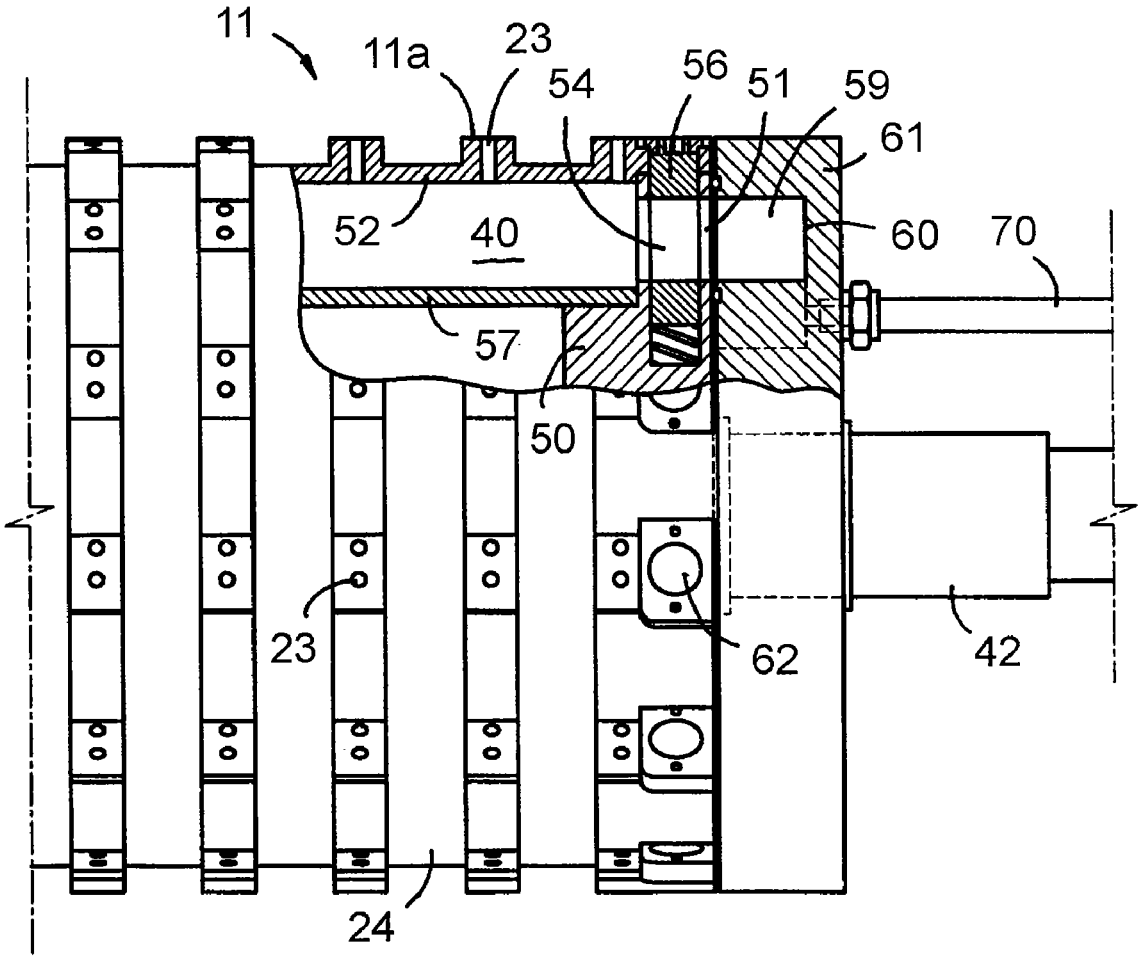
FIG. 10 is a partial cross-sectional view showing a device for handling laminar elements according to an exemplary embodiment of the present invention comprising the transfer roll of FIG. 1 and suction means.

The device comprises suction means, known by themselves and shown in FIG. 10, including a suction chamber 59 formed by a groove 60 in a stationary plate 61 leaning in a tight manner on said end surface 50*a* of the roll 11 in which said entrances 51 of the inner ducts 40 are opened. The mentioned suction chamber 59 is connected to a low pressure source (not shown) for example through a duct 70. The mentioned groove 60 has a concentric configuration encompassing an angular portion of the circumference of the end part 50 and is arranged in the path of the entrances 51. When the materials of the stationary plate 61 and of the end surface 50*a* of the roll 11 are different and have a low friction coefficient, such as for example bronze and steel, a sufficient tightness of the suction chamber 59 can be achieved by the dynamic contact with one another. However, it is also possible to install dynamic sealing gaskets to assure the tightness between said stationary plate 61 and the end surface 50*a* of the roll 11 at both sides of said path of the entrances 51. Thus, during the rotation of the roll 11, each of the entrances 51 is communicated with the suction chamber 59 along said angular portion of the circumference by applying a suction flow through the corresponding inner duct 40 and orifices 23 for the purpose of holding the laminar elements on the cylindrical surface 11*a* by suction. In an installation for handling laminar elements, the entering action of a particular entrance 51 in the suction chamber 59 during the rotation typically coincides with a position for receiving the laminar elements coming from a supply device (not shown), and the leaving action of this particular entrance 51 from the suction chamber 59 typically coincides with a position for delivering the laminar elements to a receiving device (not shown). In the transfer roll 11 of the present invention, the mentioned circumferential grooves 24 are useful for housing the ends of stationary diverting fingers (not shown) located in the delivering position and adapted to separate the laminar elements from the roll and lead them to another unit, for example.

Shutting means selectively allowing or preventing the suction flow through the orifices 23 are incorporated for the purpose of adjusting the roll 11 to laminar elements of different sizes. Therefore, each inner duct 40 is associated to at least one shutter device 56 located in a position close to its corresponding entrance 51, as shown in FIGS. 7 and 10.

Figure 8:
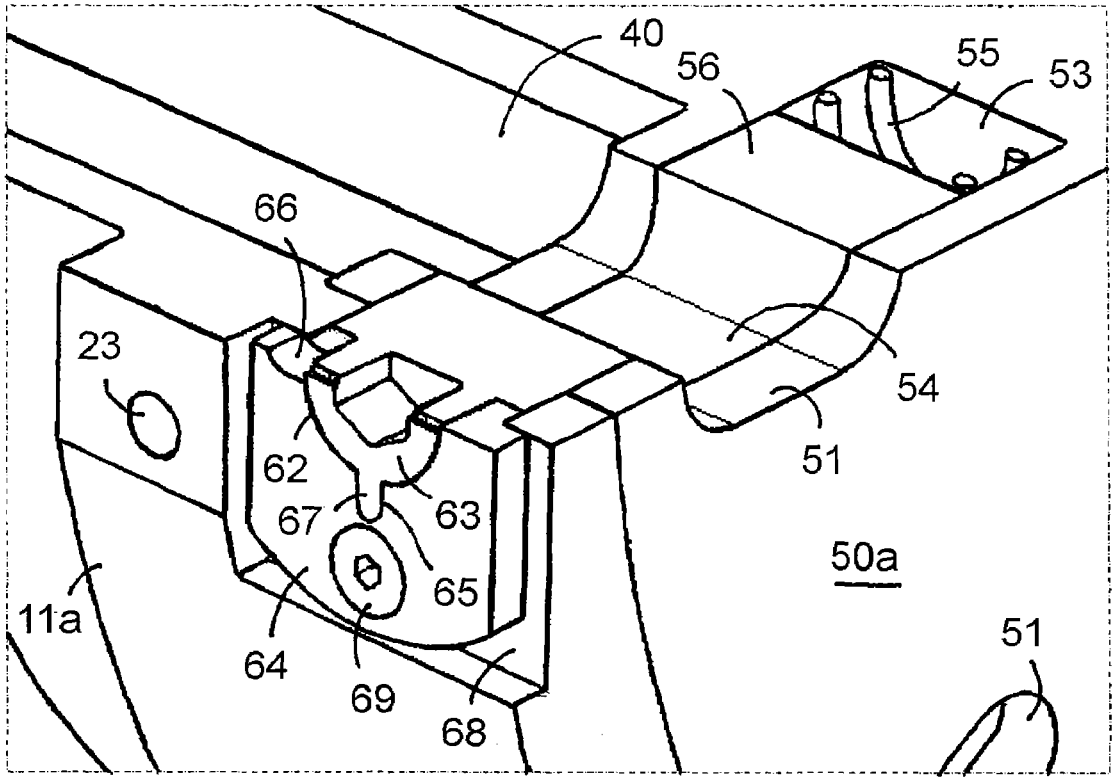
FIG. 8 is an enlarged detail of the view of FIG. 1 showing a shutter device in an open position.
Figure 9:
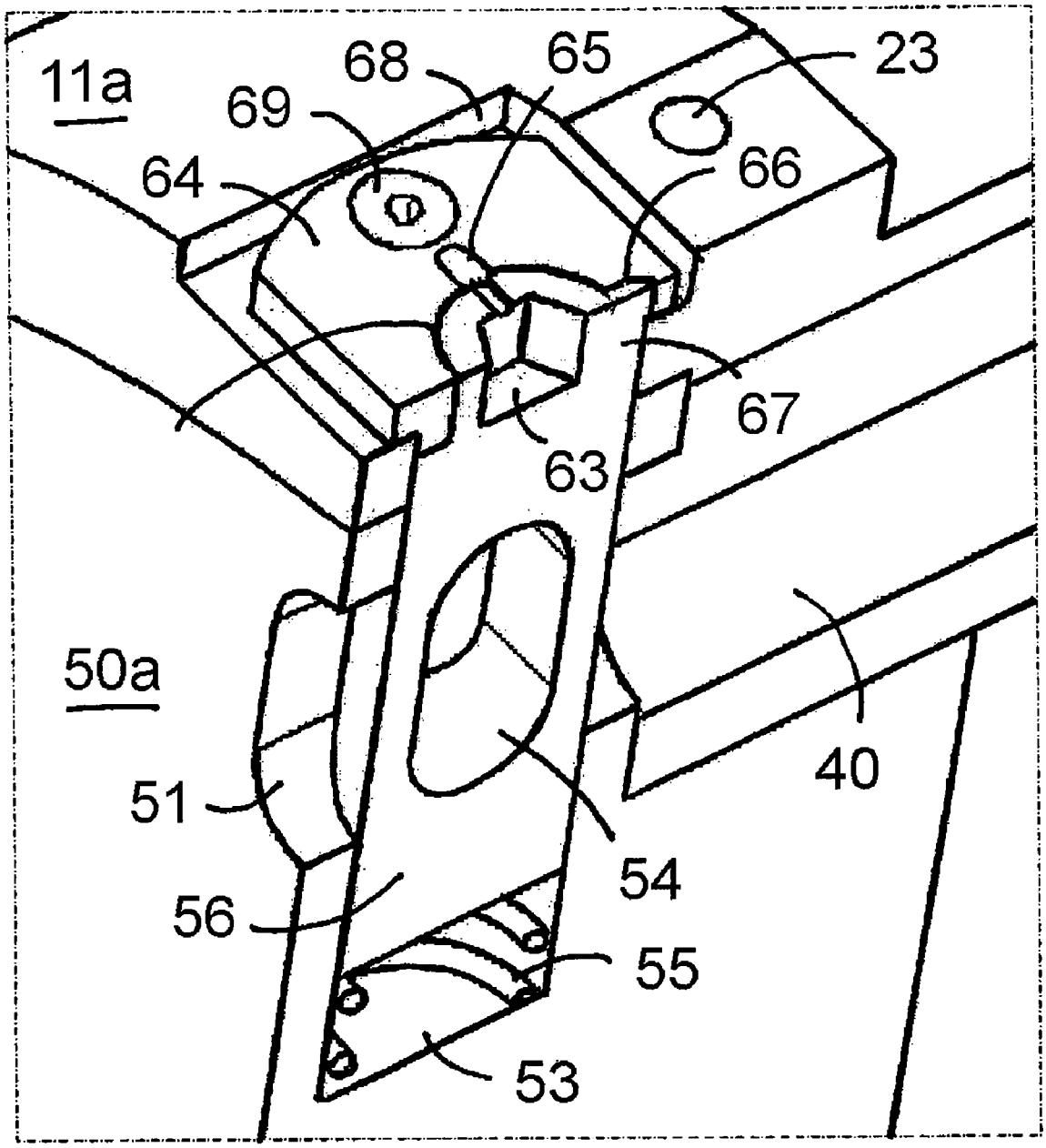
FIG. 9 is an enlarged detail from another point of view of the shutter device of FIG. 2 in a closed position.

The shutter devices are described in greater detail below in relation to FIGS. 8 and 9. According to the exemplary embodiment shown, each shutter device comprises a generally cylindrical valve body 56 retained in an also cylindrical housing 53, transverse to the corresponding inner duct 40, such that the valve body 56 can rotate in said housing 53 between open and close positions. At least one passage 54 is formed through said valve body 56. Said passage 54 is arranged such that when the valve body 56 is in the mentioned open position (FIG. 8), the passage 54 communicates at two of its ends with the inner duct 40, i.e. it communicates the entrance 51 with the remaining part of the inner duct 40 which is communicated with the orifices 23. When the valve body 56 is in the closed position (FIG. 9), the valve body 56 shuts the inner duct 40 and the passage 54 is traversed such that it does not communicate at its two ends with the inner duct 40.

Each one of the housings 53 is arranged such that the axis of rotation of the valve body 56 is aligned with a corresponding opening 62 (FIG. 10) in the cylindrical surface 11*a* of the roll 11. Each valve body 56 has a shaped head 63 suitable to be coupled by a tool through the corresponding opening 62. The mentioned shaped head 63 comprises, for example, a hexagonal cavity and said tool can be, for example, a simple Allen key. The shutter devices 56 can thus be easily accessed individually from the outside of the roll 11 so as to be selectively placed in said open position or in said closed position by means of said tool.

The shutting means preferably comprise devices for fixing the angular position of each valve body 56 inside its corresponding housing 53, both in the open position and in the closed position. To that end, according to the exemplary embodiment shown, each valve body 56 is mounted such that it can slide axially inside the corresponding housing 53 and is trapped inside the housing 53 by an entrance part 64 fixed in a corresponding recess 68 of the cylindrical surface 11*a* by means of screws 69 for example. An elastic element 55, such as a compression helical spring pushing the valve body 56 against said entrance part 64 is arranged between the inner end of the valve body 56 and the bottom of the housing 53. The opening 62 mentioned above is located in said entrance part 64 and first and second notches 65, 66 are defined in the contour of the opening 62. The head of the corresponding valve body 56 is formed to rotate in the opening 62 and comprises a lateral projection 67 adapted to fit, for example, in the first notch 65 when the valve body 56 is in the open position and in the second notch 66 when it is in the closed position.

To change, between the open and closed positions, for example, the valve body 56 can be moved (sunk) inwards by means of the mentioned tool against the force of said elastic element 55 to unlock the lateral projection 67 from the corresponding first notch 65, to then be rotated a quarter-turn and again released to house the lateral projection 67 in the second notch 66. To again change the status of the valve, i.e. to pass from the closed position to the open position, it is enough to carry out the reverse operation to change said lateral projection 67 from the second notch 66 to the first notch 65. When the valve body 56 is sunk there is no restriction for it to rotate in any of the two directions to pass from the open position to the closed position or vice versa.

It will be understood that the device can optionally comprise additional blowing means (not shown) communicated with the inner ducts 40 through their entrances 51 along at least another portion of the rotation of the roll 11 to apply a blowing flow through the same orifices 23 for the purpose of releasing the laminar elements by blowing once the suction has ended. To that end, it is enough to incorporate a blowing chamber formed by an additional groove formed in a stationary plate 61 leaning in a tight manner to said end surface 50*a* of the roll 11 in which said entrances 51 of the inner ducts 40 are opened in a manner similar to the suction chamber 59. In this case, the mentioned blowing chamber would be connected to a high pressure source (not shown) and the corresponding groove would encompass an angular portion or sector of the circular surface of the end part 50 different from that encompassed by the suction chamber. Differentiated orifices for the entrance to the ducts 40 (see FIG. 2) could alternatively be provided, the access control of which is controlled by a certain position of a valve (for example a three-way valve).

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

The invention claimed is:

1. A device for unloading laminar elements from a roll, and forming and transferring stacks of such laminar elements, comprising:

a barrier located in the path of said laminar elements when they are transported by said roll, for unloading the laminar elements from the roll in an unloading area;

a support for receiving in a stacked manner laminar elements unloaded and detained by said barrier forming a growing stack;

a separator adapted for being moved from a retracted position to an extended position interposed between first and second adjacent laminar elements, where said first laminar element completes a finished stack on said support and said second laminar element is momentarily held by said separator in order to begin a new growing stack while said finished stack is taken off the support;

a push element adapted for being moved from a retracted position to an extended position for pushing the finished stack and transferring it from the support to an outlet support; and support actuation means being provided to move said support away from said unloading area as the growing stack grows and adapted to maintain a predetermined pressure between a last laminar element of the growing stack and a cylindrical surface of the roll, the support being linked to a rod of a piston housed in a cylinder containing a compressible fluid in a chamber, and a detecting device is provided to detect a parameter representative of the pressure in said chamber, the detecting unit of said detecting device being connected with control means controlling the support actuation means for moving said support while maintaining said predetermined pressure.

2. The device according to claim 1, wherein said support actuation means is adapted to move the mentioned support away from said unloading area at a speed according to a growing speed of the growing stack.

3. The device according to claim 2, wherein said support actuation means are adapted to move the support, once the finished stack is completed by the movement of the separator to its extended position, away from said unloading area until placing it at the level of said outlet support, at a speed greater than said growing speed of the growing stack on the separator.

4. The device according to claim 3, wherein the separator is adapted for being moved to a distance from said unloading area while the growing stack is formed thereon.

5. The device according to claim 4, wherein the support actuation means comprises a motor connected so as to rotate at least one screw coupled to a nut fixed to a mobile support guided linearly by at least one guide mounted on a frame, the support being fixed to said mobile support.

6. The device according to claim 3, wherein said support actuation means is adapted to move the support, once the finished stack is transferred to the outlet support by the movement of the push element, bringing it closer to said unloading area at a speed greater than said growing speed of the growing stack, to receive the growing stack initiated on the separator when the separator is again moved to its retracted position.

7. The device according claim 6, wherein the support actuation means comprises a motor connected so as to rotate at least one screw coupled to a nut fixed to a mobile support guided linearly by at least one guide mounted on a frame, the support being fixed to said mobile support.

8. The device according to claim 6, wherein the support actuation means comprises a linear actuator.

9. The device according to claim 3, wherein the support actuation means comprises a motor connected so as to rotate at least one screw coupled to a nut fixed to a mobile support guided linearly by at least one guide mounted on a frame, the support being fixed to said mobile support.

10. The device according to claim 3, wherein the support actuation means comprises a linear actuator.

11. The device according to claim 4, wherein the support actuation means comprises a linear actuator.

12. The device according to claim 2, wherein the support actuation means comprises a motor connected so as to rotate at least one screw coupled to a nut fixed to a mobile support guided linearly by at least one guide mounted on a frame, the support being fixed to said mobile support.

13. The device according claim 2, wherein the support actuation means comprises a linear actuator.

14. The device according to claim 1, wherein the support actuation means comprises a motor connected so as to rotate at least one screw coupled to a nut fixed to a mobile support guided linearly by at least one guide mounted on a frame, the support being fixed to said mobile support.

15. The device according to claim 1, wherein the support actuation means comprises a linear actuator.

16. The device according to claim 1, further comprising a retainer adapted for being moved from a retracted position to an extended position to retain the finished stack on the outlet support when said push element is again moved to its retracted position.

17. The device according to claim 16, further comprising retainer actuation means to actuate the movements of said retainer between its retracted and extended positions.

18. The device according to claim 17, wherein said retainer actuation means comprise at least one linear actuator mounted on a frame.

19. The device according to claim 18, wherein said linear actuator is a fluid dynamic cylinder.

20. The device according to claim 1, further comprising first separator actuation means to actuate the movements of the separator between its retracted and extended positions.

21. The device according to claim 20, further comprising second separator actuation means to actuate movements of the separator in a direction that is substantially parallel to the barrier, between a position adjacent to the roll and a position separated from the roll.

22. The device according to claim 21, wherein the separator is mounted to be moved by said first separator actuation means, and the first separator actuation means together with the separator are mounted to be moved by said second separator actuation means.

23. The device, according to claim 22, wherein the first separator actuation means comprise at least one linear actuator with a mobile part fixed to the separator and a fixed part mounted on a mobile support connected to at least one rod of a linear actuator mounted on a frame.

24. The device according to claim 23, wherein said linear actuator is a fluid dynamic cylinder.

25. The device according to claim 1, further comprising push element actuation means to actuate the movements of said push element between its retracted and extended positions.

26. The device according to claim 25, wherein said push element actuation means comprise a linear actuator with a mobile part fixed to the push element and a fixed part mounted on a frame.

27. The device according to claim 26, wherein said linear actuator is a fluid dynamic cylinder.

28. The device according to claim 1, wherein the roll comprises suction orifices for holding the laminar elements on a cylindrical surface of the roll along a part of their rotation path between a supply device for supplying laminar elements and said unloading area, said suction orifices being ordered in rows parallel to the shaft of the roll and in circumferential lines perpendicular to the shaft of the roll, and ring-shaped grooves being arranged on said cylindrical surface of the roll between said circumferential lines of suction orifices.

29. The device according to claim 28, wherein said suction orifices are open at recessed surfaces, each of which forms a step with the cylindrical surface in its front end and converges with the cylindrical surface at its rear end, said ring-shaped grooves being deeper than said step.

30. The device according to claim 29, wherein the barrier comprises a plurality of barrier fingers arranged aligned with the circumferential lines of suction orifices of the roll, and the separator comprises a plurality of separator fingers adapted to be introduced inside the ring-shaped grooves of the roll through separating spaces between said barrier fingers when the separator is moved to its extended position.

31. The device according to claim 30, wherein each of the separator fingers has a wedge end which is located close to a bottom of the corresponding ring-shaped groove, in a position deeper than the steps.

32. The device according to claim 31, wherein the support comprises a plurality of support fingers arranged aligned with the barrier fingers and substantially perpendicular thereto, said support fingers being adapted to be moved along said separating spaces between the barrier fingers when the support is moved between the unloading area and the level of said outlet support.

33. The device according to claim 32, wherein said push element comprises a plurality of push element fingers adapted to pass through separating spaces between said barrier fingers and through separating spaces between said support fingers when the push element is moved to its extended position.

34. The device according to claim 33, further comprising a retainer adapted for being moved by retainer actuation means from a retracted position to an extended position to retain the finished stack on the outlet support when said push element is again moved to its retracted position, said retainer comprising a plurality of retainer fingers adapted to pass between said push element fingers when the retainer is moved to its extended position.

35. The device according to claim 1, wherein said roll includes holding means comprising:

orifices arranged in rows substantially parallel to the shaft of the roll distributed at angular intervals in said cylindrical surface;

inner ducts, each of which is communicated with those of said orifices forming at least one of said rows and with at least one entrance adapted to be placed in communication with suction means along at least part of the rotation of the roll to apply a suction flow through the orifices for the purpose of holding the laminar elements by vacuum; and shutting means to selectively allow or prevent said suction flow through the orifices for the purpose of adjusting the roll to laminar elements of different sizes, said shutting means comprising a shutter device associated to each inner duct, each shutter device being configured and arranged to be changed between a open position, in which a flow between the inner duct and the suction means is allowed and a closed position, in which said flow between the inner duct and the suction means is prevented.

36. The device according to claim 35, wherein each of the shutter devices is individually accessible from outside to be selectively placed in said open position or in said closed position.

37. The device according to claim 35, wherein each shutter device comprises a valve body retained in a housing transverse to the corresponding inner duct and adapted to rotate in said housing between said open and closed positions.

38. The device according to claim 37, wherein at least one passage is formed through said valve body, said passage communicating at its two ends with the inner duct in the open position and not communicating at its two ends with the inner duct in the close position.

39. The device according to claim 37, wherein the housings are arranged such that axes of rotation of the valve bodies are aligned with respective openings close to an end of the cylindrical surface, and the valve bodies have respective shaped heads suitable to be coupled by a tool through said openings to be rotated between the open and closed positions.

40. The device according to claim 39, further comprising means for fixing the angular position of each valve body inside its corresponding housing in the open position and in the closed position.

41. The device according to claim 40, wherein each valve body is slidingly mounted inside the corresponding housing and is trapped therein by an entrance part fixed to cylindrical surface, with an elastic element pushing the valve body against said entrance part, the opening being defined in said entrance part and first and second notches being defined in the contour of the opening, said notches housing, in the open and close positions respectively, a lateral projection provided in the head of the corresponding valve body, the valve body being able to move against the force of said elastic element), rotated and released by means of said tool to change the housing of said lateral projection between said first and second notches.

42. The device according to claim 35, wherein said entrances of the inner ducts are open at a front end surface adapted to be joined to a suction chamber formed by a groove in a stationary plate, said suction chamber being connected to a low pressure source forming part of said suction means.

43. A method for unloading laminar elements from a roll, and forming and transferring stacks of such laminar elements, comprising:

unloading the laminar elements from the roll in an unloading area with the aid of a barrier located in the path of said laminar elements when they are transported by said roll;

receiving in a stacked manner by means of a support the laminar elements unloaded and detained by said barrier forming a growing stack;

moving a separator from a retracted position to an extended position interposed between first and second adjacent laminar elements, where said first laminar element completes a finished stack on said support and said second laminar element is momentarily held by said separator in order to begin a new growing stack while said finished stack is taken off the support;

moving the support by means of support actuation means away from said unloading area as the growing stack grows while maintaining a predetermined pressure between a last laminar element of the growing stack and a cylindrical surface of the roll using said support actuation means in response to a detection of a parameter representative of the pressure of a chamber of a cylinder containing a compressible fluid against which a piston with a rod joined to said support is applied;

moving the support to the level of an outlet support and pushing the finished stack to transfer it from the support to said outlet support by means of a push element adapted for being moved from a retracted position to an extended position; and moving the support to the level of the separator and removing the separator to its retracted position to transfer said new growing stack from the separator to the support.

44. The method according to claim 43, further comprising moving the support by means of support actuation means away from said unloading area at a speed according to a growing speed of the growing stack.

* * * * *